US008789985B1

(12) United States Patent
Kira

(10) Patent No.: US 8,789,985 B1
(45) Date of Patent: Jul. 29, 2014

(54) LIGHTING FIXTURE WITH AN LED HEAT SINK CONNECTED TO A SOCKET HOUSING WITH A HEAT-DISSIPATING MEMBER

(71) Applicant: Hiroshi Kira, Newbury Park, CA (US)

(72) Inventor: Hiroshi Kira, Newbury Park, CA (US)

( * ) Notice: Subject to any disclaimer, the term of this patent is extended or adjusted under 35 U.S.C. 154(b) by 0 days.

(21) Appl. No.: 13/855,593

(22) Filed: Apr. 2, 2013

(51) Int. Cl.
*F21V 33/00* (2006.01)

(52) U.S. Cl.
USPC ..... 362/373; 362/294; 362/249.02

(58) Field of Classification Search
USPC ..... 362/249.02, 373, 294, 800
See application file for complete search history.

(56) References Cited

U.S. PATENT DOCUMENTS 7,198,386 B2 * 4/2007 Zampini et al. ..... 362/294
7,748,870 B2 * 7/2010 Chang et al. ..... 362/294
7,841,752 B2 * 11/2010 Lee ..... 362/373
8,167,460 B2 * 5/2012 Chu ..... 362/294
8,444,303 B2 * 5/2013 Chu ..... 362/373
8,517,569 B2 * 8/2013 Chen et al. ..... 362/294
8,602,597 B2 * 12/2013 Lopez et al. ..... 362/294
2009/0237932 A1 * 9/2009 Lee ..... 362/249.02
2009/0310381 A1 * 12/2009 Chang et al. ..... 362/555
2011/0157872 A1 * 6/2011 Chu ..... 362/101

* cited by examiner

*Primary Examiner* — Anabel Ton
(74) *Attorney, Agent, or Firm* — Roy L. Anderson; Wagner, Anderson & Bright PC

(57) ABSTRACT

A light source used in a lighting fixture with a socket housing with a pair of plug-in receptacles has a pair of pins that are plugged into the socket housing, an LED assembly, a driver module for driving the LED assembly which is in physical and electrical contact with the pair of pins, and a light source heat sink for dissipating heat from the light source. A heat-dissipating member is physically and thermally connected to the light source heat sink and is also thermally connected to the socket housing, and the driver module thermally insulates the light source heat sink from the socket housing.

20 Claims, 2 Drawing Sheets

LIGHTING FIXTURE WITH AN LED HEAT SINK CONNECTED TO A SOCKET HOUSING WITH A HEAT-DISSIPATING MEMBER

FIELD OF THE INVENTION

The field of the present invention is lighting fixtures with LED lights sources.

BACKGROUND OF THE INVENTION

A multifaceted reflector (MR) light bulb is a format for halogen bulbs. Examples of MR bulbs include MR16 and MR11. Such light bulbs can also be made with light emitting diodes ("LEDs"). LED light sources, particularly LED light sources such as the MR16 form factor, can generate a lot of heat due to multiple LEDS arrayed in series upon a thermally conductive substrate. One way to help dissipate heat from such LED light sources is to include a heat sink surrounding the thermally conductive substrate, such as is taught in U.S. Ser. No. 13/025,860, filed Aug. 25, 2011, to Shum at al., the disclosure of which is specifically incorporated herein by reference. The present invention discloses a novel way of increasing the life of LED bulbs, such as an MR16, used in lighting fixtures used in a variety of applications.

SUMMARY OF THE INVENTION

The present invention is generally directed to a lighting fixture which has a socket housing with a pair of plug-in receptacles into which a light source is plugged. In particular, the light source has a pair of pins that are plugged into the socket housing, an LED assembly, a driver module for driving the LED assembly which is in physical and electrical contact with the pair of pins, and a light source heat sink for dissipating heat from the light source. A heat-dissipating member is physically and thermally connected to the light source heat sink and is also thermally connected to the socket housing, and the driver module thermally insulates the light source heat sink from the socket housing.

In accordance with certain aspects of the present invention, the LED assembly has multiple LEDS arrayed on a thermally conductive substrate, the heat-dissipating member can be multiple rods (e.g., four, eight or more), and the light source heat sink can have fins into which the heat-dissipating members or rods fit, while the light source can be an MR 16 form factor. The heat-dissipating member(s) can be mechanically secured to the socket housing (e.g., through use of a male to a female connection) or to a socket adapter that is thermally connected to the socket housing and adapted to mechanically receive the plurality of heat-dissipating members. The lighting fixture can have a hood in which the light source is maintained without a friction fit between the light source heat sink and the hood.

Accordingly, it is a primary object of the present invention to provide improved lighting fixtures that use LED bulbs.

This and further objects and advantages will be apparent to those skilled in the art in connection with the drawings and the detailed description of the invention set forth below.

DETAILED DESCRIPTION OF THE INVENTION

In the Figures, and the following more detailed description, numerals indicate various features of the invention, with like numerals referring to like features throughout both the drawings and the description.

Although the Figures are described in greater detail below, the following is a glossary of the elements identified in the Figures.

| | |
|---|---|
| 1 | lighting fixture |
| 2 | hood |
| 3 | socket housing |
| 4 | plug-in receptacles |
| 5 | heat-dissipating female receptacle |
| 6 | heat-dissipating male connection |
| 7 | heat-dissipating rod |
| 10 | light source |
| 11 | light source heat sink |
| 12 | light source heat sink fin |
| 13 | LED assembly |
| 15 | driver module |
| 16 | socket adapter |
| 17 | light source power pins |

Figure 1:
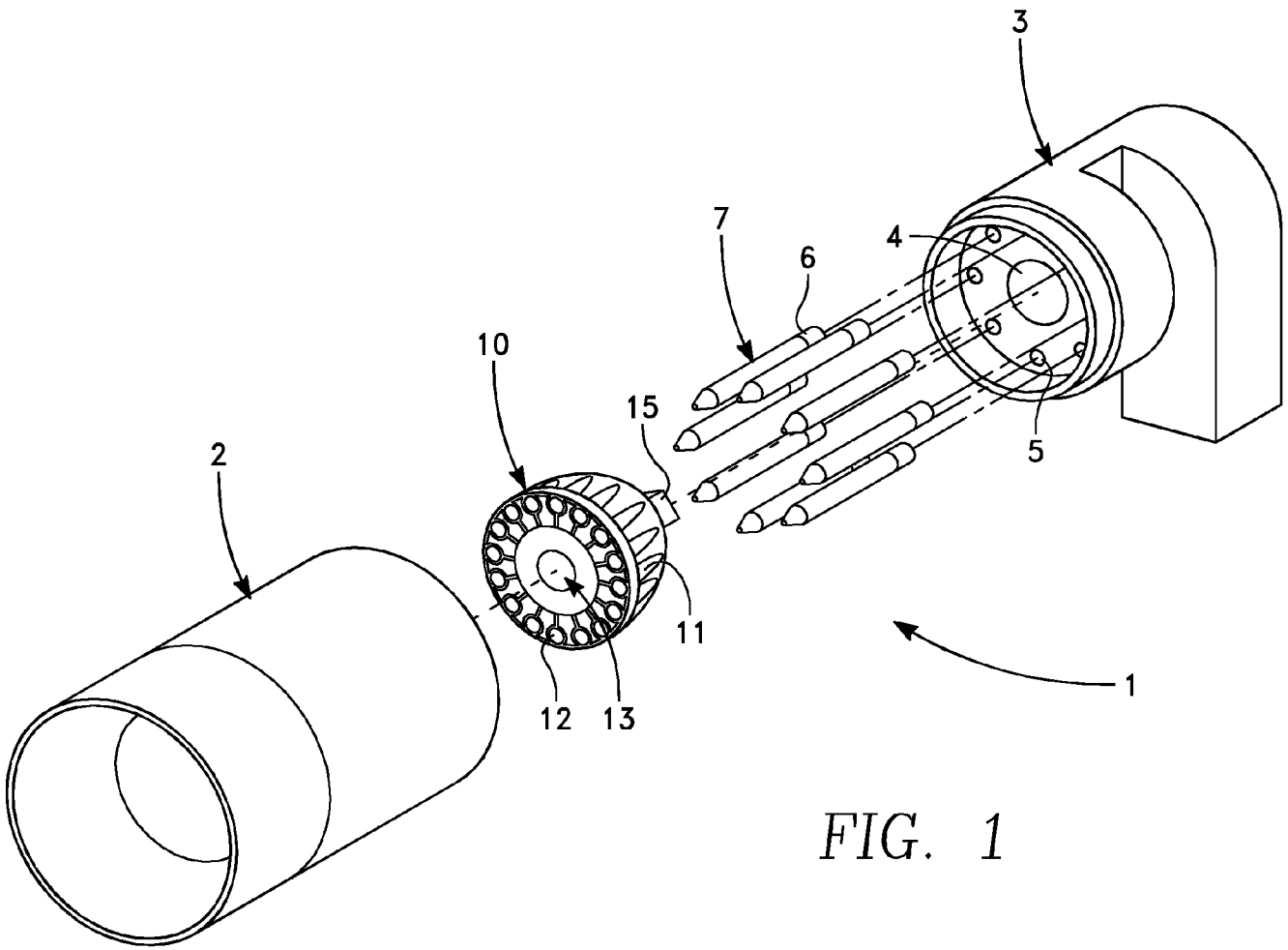
FIG. 1 is an exploded view diagram showing how components of a lighting device according to the present invention are assembled.
Figure 2:
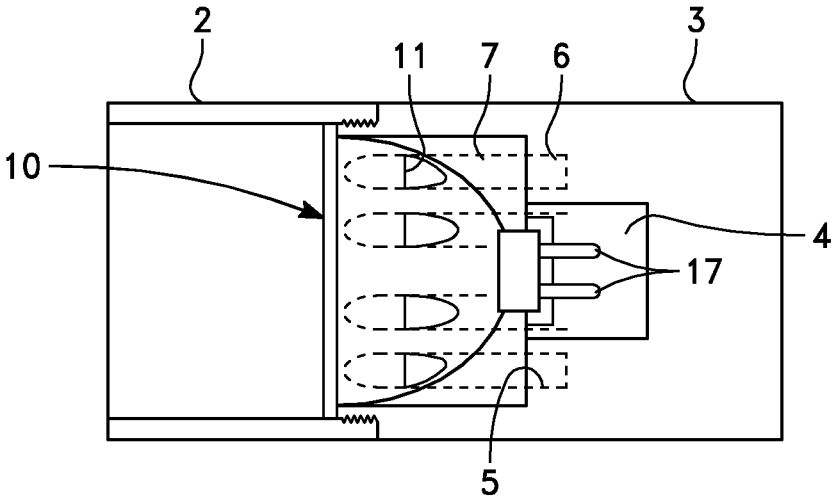
FIG. 2 illustrates how multiple conductive rods according to the present invention are fit into multiple heat dissipating fins of a light source in accordance with the present invention.

The present invention is not limited to any particular lighting fixture, and is applicable to indoor and outdoor lighting fixtures, for residential and commercial use, whether mounted on a wall, a ceiling or with landscaping outdoors, or used with a different type of lighting fixture. Such lighting fixtures may have a hood, but need not always have a hood. FIG. 1 illustrates an example of one such lighting fixture, shown generally as 1, that can be used for outdoor use which has a hood 2. Hood 2 may have a face cap, a transparent cover with an o-ring to make the hood watertight and a base that is then mechanically connected to a socket housing 3. Socket housing 3 has a pair of plug-in receptacles 4 for receiving a pair of light source power pins 17.

The light source 10 used in the present invention has an LED assembly 13 which is surrounded by a light source heat sink 11. Light source heat sink 11 can have fins 12 as taught in U.S. Ser. No. 13/025,860, filed Aug. 25, 2011, to Shum et al., although the present invention is not limited to light source heat sinks only having such fins. Light source 10 has a driver module 15 for driving LED assembly 13 which is in physical and electrical contact with the pair of light source power pins 17. Light source heat sink 11 is thermally isolated from socket housing 3 by driver module 15 and light source heat sink 11 is not thermally connected to hood 2 because there is no friction fit between light source heat sink 11 and hood 2 so that hood 2 can easily be removed from socket housing 3 to gain access to light source 10 when light source 10 needs to be replaced.

The present invention provides a thermal connection between light source heat sink 11 and socket housing 3 by using one or more heat-dissipating elements to create a heat-dissipation path between light source heat sink 11 and socket housing 3. In one preferred embodiment, multiple rods are used to create the heat-dissipation path, and in an especially preferred embodiment the multiple rods are sized such that the rods will fit into and create thermal contact with multiple 11 fins 12. For example, it has been found that the use of four such rods lowers the operating temperature of a MR 16 form factor bulb sold by Soraa, Inc., while the use of eight such rods lowers the operating temperature even further, and the use of eight such rods is illustrated in FIG. 1

Figure 3:
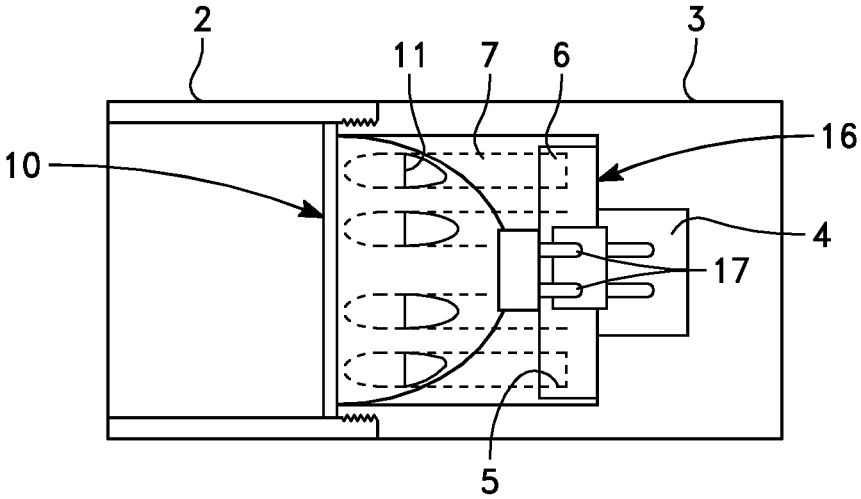
FIG. 3 illustrates use of a socket housing adapter designed for use in a lighting device according to the present invention.

Each of heat-dissipating rods 7 can have a male or female connection designed to mechanically engage with a corresponding female or male connection in socket housing 3 to create a mechanical fit (other forms of mechanical fits are also possible in alternative embodiments of the present invention). FIG. 1 illustrates heat-dissipating rods 7 having male connections 6 designed to screw into heat-dissipating female receptacles 5 created in socket housing 3. For new socket housings 3, threaded holes 5 designed to receive threads in rods 7 can easily be machined at the time of manufacture, whereas existing socket housings 3 that do not have such threads can either be retrofit to create such threads or, more preferably, a socket adapter 16 (illustrated in FIG. 3) having such threaded holes can be mechanically secured to socket housing 3. Such a socket adapter 16 will be thermally connected to socket housing 3 and adapted to mechanically receive the plurality of heat-dissipating members. Use of a socket adapter designed to fit a given lighting fixture helps to save time in the field when used with existing lighting fixtures because it is much easier to install without the need for drilling holes in installed socket housings.

While the invention has been described herein with reference to certain preferred embodiments, those embodiments have been presented by way of example only, and not to limit the scope of the invention. Additional embodiments thereof will be obvious to those skilled in the art having the benefit of this detailed description. Further modifications are also possible in alternative embodiments without departing from the inventive concept.

Accordingly, it will be apparent to those skilled in the art that still further changes and modifications in the actual concepts described herein can readily be made without departing from the spirit and scope of the disclosed inventions as defined by the following claims.

What is claimed is:

1. A lighting fixture, comprising:

a socket housing with a pair of plug-in receptacles;

a light source mechanically held by the socket housing, said light source comprising:

a pair of pins plugged into the pair of plug-in receptacles;

a light emitting diode ("LED") assembly;

a driver module for driving the LED assembly, said driver module being in physical and electrical contact with the pair of pins; and a light source heat sink for dissipating heat from the light source; and a heat-dissipating member physically and thermally connected to the light source heat sink that is also thermally connected to the socket housing;

wherein the driver module thermally insulates the light source heat sink from the socket housing; and wherein the heat-dissipating member is not directly connected to the LED assembly so that heat from the LED assembly must be transferred through the light source heat sink to the heat-dissipating member.

2. The lighting fixture of claim 1, wherein the LED assembly is comprised of a plurality of LEDS arrayed on a thermally conductive substrate.

3. The lighting fixture of claim 2, wherein the heat-dissipating member is comprised of a plurality of rods.

4. The lighting fixture of claim 3, wherein the plurality of heat-dissipating members is comprised of four or more rods.

5. The lighting fixture of claim 4, wherein the plurality of heat-dissipating members is comprised of eight rods.

6. The lighting fixture of claim 3, wherein the light source heat sink is comprised of a plurality of fins and the plurality of heat-dissipating members are fit into said plurality of fins.

7. The lighting fixture of claim 2, wherein the light source is comprised of an MR 16 form factor.

8. The lighting fixture of claim 1, wherein the plurality of heat-dissipating members are mechanically secured to the socket housing.

9. The lighting fixture of claim 8, wherein the wherein the plurality of heat-dissipating members are mechanically secured to the socket housing through use of a male to a female connection.

10. The lighting fixture of claim 1, further comprising a socket adapter mechanically secured to the socket housing, said socket adapter being thermally connected to said socket housing and adapted to mechanically receive the plurality of heat-dissipating members.

11. The lighting fixture of claim 1, further comprising a hood secured to the socket housing, said light source being maintained within an opening formed inside of the hood and the socket housing.

12. The lighting fixture of claim 1, wherein there is not a friction fit between the light source heat sink and the hood.

13. A lighting fixture, comprising:

a hood;

a socket housing with a pair of plug-in receptacles;

a light source held within the hood and the socket housing, said light source comprising:

a pair of pins plugged into the pair of plug-in receptacles;

a light emitting diode ("LED") assembly comprised of a plurality of LEDs arrayed on a thermally conductive substrate;

a driver module for driving the LED assembly, said driver module being in physical and electrical contact with the pair of pins; and a light source heat sink for dissipating heat from the light source; and a heat-dissipating member physically and thermally connected to the light source heat sink that is also thermally connected to at least one of the hood and the socket housing;

wherein there is not a friction fit between the light source heat sink and the hood;

wherein the driver module thermally insulates the light source heat sink from the socket housing;

wherein the heat-dissipating member is not directly connected to the LED assembly so that heat from the LED assembly must be transferred through the light source heat sink to the heat-dissipating member; and wherein the hood is thermally connected to the socket housing.

14. The lighting fixture of claim 13, wherein the heat-dissipating member is comprised of a plurality of heat-dissipating elements.

15. The lighting fixture of claim 14, wherein the light source is comprised of an MR 16 form factor.

16. The lighting fixture of claim 15, further comprising a socket adapter physically secured to the socket housing, said socket adapter being thermally connected to said socket housing and adapted to mechanically receive the plurality of heat-dissipating members.

17. The lighting fixture of claim 15, wherein the light source heat sink is comprised of a plurality of fins and the plurality of heat-dissipating elements are fit into said plurality of fins.

18. A method for dissipating heat from a light source held within a lighting apparatus, wherein said light source utilizes a light emitting diode ("LED") assembly which is thermally and electrically isolated from a socket housing of the lighting apparatus by a driver module and the LED assembly has a heat sink for dissipating heat that is not thermally connected to the driver module, comprising:

thermally connecting the heat sink to the socket housing of the lighting apparatus by use of at least one heat-dissipating element wherein the at least one heat-dissipating element is not directly connected to the LED assembly so that heat from the LED assembly must be transferred through the heat sink to the heat-dissipating member.

19. The method of claim 18, wherein a plurality of heat-dissipating elements are mechanically and thermally connected to the socket housing and to the heat sink.

20. The method of claim 19, comprising the additional steps of:

mechanically and thermally connecting a socket adapter to the socket housing; and physically and thermally connecting a plurality of heat-dissipating elements to the socket adapter and the heat sink.

* * * * *